United States Patent [19]

Bodine

[11] Patent Number: 4,667,742

[45] Date of Patent: May 26, 1987

[54] DOWN HOLE EXCITATION SYSTEM FOR LOOSENING DRILL PIPE STUCK IN A WELL

[76] Inventor: Albert G. Bodine, 7877 Woodley Ave., Van Nuys, Calif. 91406

[21] Appl. No.: 824,600

[22] Filed: Jan. 31, 1986

Related U.S. Application Data

[63] Continuation-in-part of Ser. No. 709,885, Mar. 8, 1985.

[51] Int. Cl.[4] ..... E21B 31/16

[52] U.S. Cl. ..... 166/301; 175/56

[58] Field of Search ..... 166/301; 175/55, 56; 415/502

[56] References Cited

U.S. PATENT DOCUMENTS

| | | | |
|---|---|---|---|
| 3,155,163 | 11/1964 | Bodine, Jr. | 166/301 |
| 3,168,140 | 2/1965 | Bodine, Jr. | 175/56 |
| 3,633,688 | 1/1972 | Bodine | 175/56 |
| 4,261,425 | 4/1981 | Bodine | 175/55 |
| 4,271,915 | 6/1981 | Bodine | 175/56 |

*Primary Examiner*—James A. Leppink
*Assistant Examiner*—Terry Lee Melius
*Attorney, Agent, or Firm*—Edward A. Sokolski

[57] ABSTRACT

The location of a section of drill pipe which has become stuck in a well some distance from the surface is first determined. The drill string above this location is unfastened from the drill string and removed from the well. A mechanical oscillator is connected to the bottom of the re-installed drill string through a sonic isolator section of drill pipe designed to minimize transfer of sonic energy to the sections of drill string above the oscillator. The oscillator is connected to the down hole stuck drill pipe section for transferring sonic energy thereto. A mud turbine is connected to the oscillator, this turbine being rotatably driven by a mud stream fed from the surface. The turbine rotates the oscillator to generate sonic energy typically in a torsional or quadrature mode of oscillation, this sonic energy being transferred to the stuck section of drill pipe to effect its freeing from the walls of the well.

4 Claims, 9 Drawing Figures

DOWN HOLE EXCITATION SYSTEM FOR LOOSENING DRILL PIPE STUCK IN A WELL

This application is a continuation-in-part of my application Ser. No. 709,885 filed Mar. 8, 1985.

This invention relates to oil well drilling and more particularly to a method and apparatus for sonically freeing a section of drilling string which has become stuck in a well.

In the drilling of an oil well, sections of drilling string at times becomes stuck in the well bore making it impossible to continue the drilling operation. A proven technique described in the prior art for freeing a section of casing from the well bore is the application of sonic energy to a drilling string at or near the surface of the ground to resonate the entire string in a longitudinal mode of vibration down to the drilling string connection point at which the stuck casing is lodged. In situations where the stuck section of pipe is a considerable distance below the surface of the earth, it has been found that it is difficult to transmit sonic energy at a sufficient energy level to effect the freeing thereof. This is due to the fact that at such great depths at the usual effective frequencies of vibration (10–100 Hz), high order overtone harmonic resonance must be employed with high losses in the interconnecting drill string. It therefore is highly desirable to generate the sonic energy down hole close to the point at which the string is stuck in the well bore, and to effectively isolate the sonic energy from the sections of drill string above this point so that a maximum amount of energy is available at or near a fundamental of the desired frequency of vibration for the stuck column of pipe.

The method and apparatus of the present invention achieves such low order harmonic down hole sonic excitation of the section of drill string which is lodged in the ground in a highly effective manner. This improvement is achieved in the present invention by also applying sonic energy in a torsional or quadrature mode of vibration near the troubled point in the following manner: First the location of the subsection of drill string is determined by means of a conventional free point indicator instrument which is lowered down inside of the drill string. The drill string above this point is then "backed off" (unscrewed) in a conventional fashion at a chosen distance above the stuck point, the lower stuck portion of the string being left in the well bore. This predetermined chosen distance provides a chosen length of stuck drill string portion to be resonantly driven and thus influences the fundamental and low order harmonic resonant frequency of the sonic energy applied. It is to be noted that for either torsional or quadrature vibrational types of lateral modes the physical length of drill string required for any particular vibrational resonance frequency is much shorter than for longitudinal vibration.

The sonic oscillator, with a pipe section thereabove designed to respond and present a low impedence to the top of the oscillator housing and a high impedence where it is connected to the drill string above, is connected to the bottom end of the reinstalled drill string. This oscillator along with the drill string is lowered back into the well bore and engages down hole the above described chosen length of stuck drill pipe which remains above the region in which the original string is stuck. This may be accomplished is some instances by screwing a tool joint at the bottom of the oscillator housing into the tool joint at the top of the chosen down hole pipe section. In other instances, particularly where the end of the drill string section to be retrieved had become twisted off, engagement of this down hole section is achieved by means of a conventional spear or internally toothed over-shot grapple connected to the bottom of the oscillator. The oscillator assembly includes a mud turbine drive mechanism, this mud turbine being driven by a flow of mud fed down the drill string from the surface. The oscillator is driven in either a torsional or quadrature mode of vibration to provide lateral mode sonic energy down the resonantly vibrating chosen length of drill string, this energy operating to free the section of string stuck in the well bore.

After the drill string has been loosened, the sonic unit is usually removed and the drill string then made up conventionally to continue drilling. However, if further impending difficulty is suspected, the sonic oscillator can be left in the drill string as drilling continues thus continuing its sonic action for maintaining looseness of the string or rapidly breaking the string loose if any sticking should reoccur. Continuous operation of the oscillator also provides energy to the drilling bit which aids in the drilling action.

It is therefore an object of this invention to facilitate the freeing of pipes stuck in a well at a considerable distance below the surface.

It is a further object of this invention to provide down hole sonic excitation for usé in freeing a section of drill string stuck in a well bore.

Other objects of this invention will become apparent from the following description taken in connection with the accompanying drawings of which, FIGS. 1A and 1B are elevational views illustrating a first embodiment of the invention;

Figure 1A:
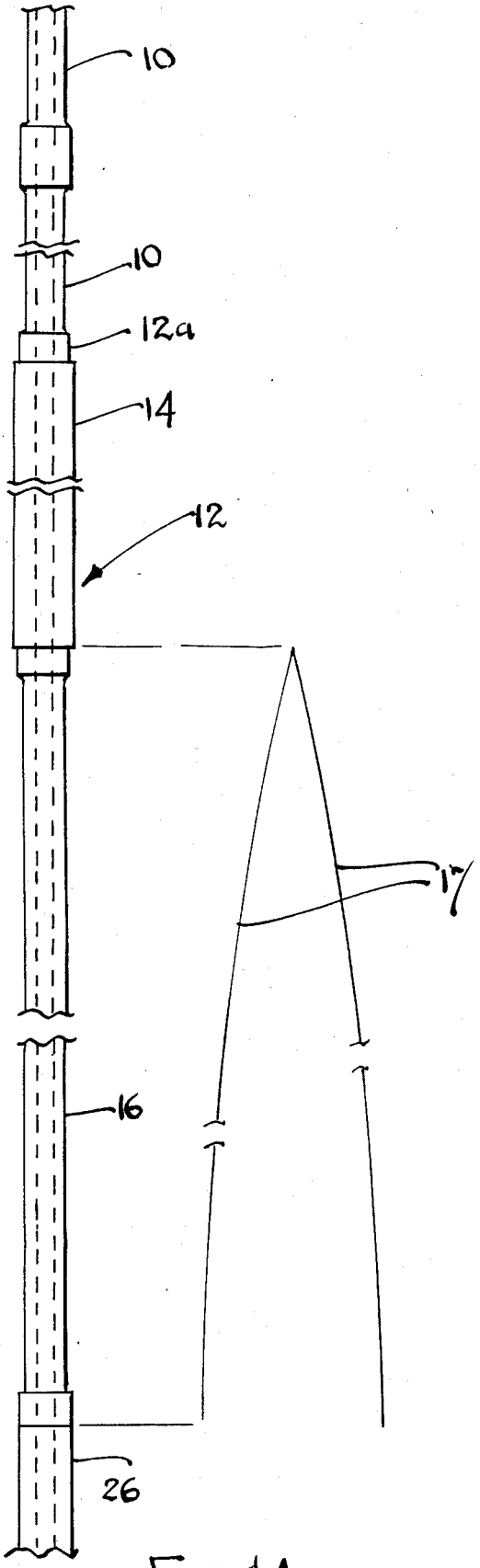
Figure 1B:
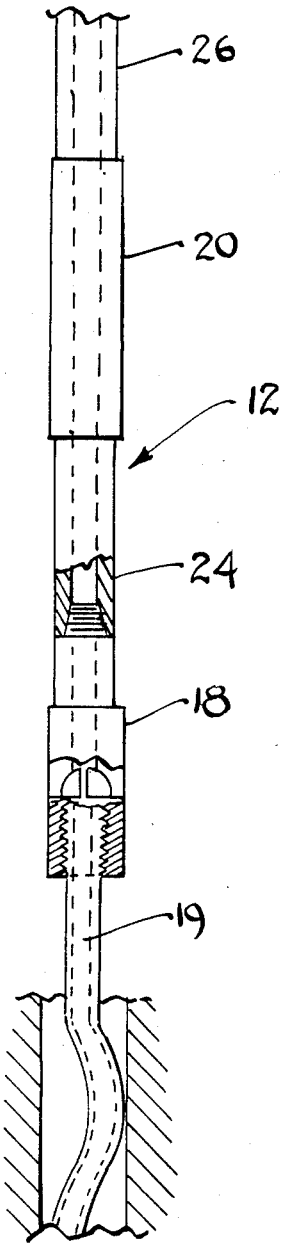

Referring now to FIGS. 1A and 1B, the basic elements of the system of the invention are illustrated. As previously explained, the upper portion of the drill string above the stuck portion 19 is first backed off or broken off and removed from the well. An upper portion of drill string 10 is reinstalled after being threadably joined to the top 12A of the system of the invention 12 which includes a heavy mass collar isolation member 14 at its top which in turn is coupled to an elastic spring pipe section 16. Elastic spring pipe 16 and heavy mass 14 form a resonant vibration system in the frequency range of operation of the oscillator contained in sonic generator unit 20 as indicated by the standing wave pattern shown by graph lines 17. This provides a low impedance at the operating frequency to the upper end of the sonic drive unit 20 thus minimizing the dissipation of sonic energy in the drill string 10. Sonic drive unit 20 is threadably coupled to toothed grappling assembly 18 which is placed in firm engagement with the top end of the stuck pipe section 19.

Figure 2A:
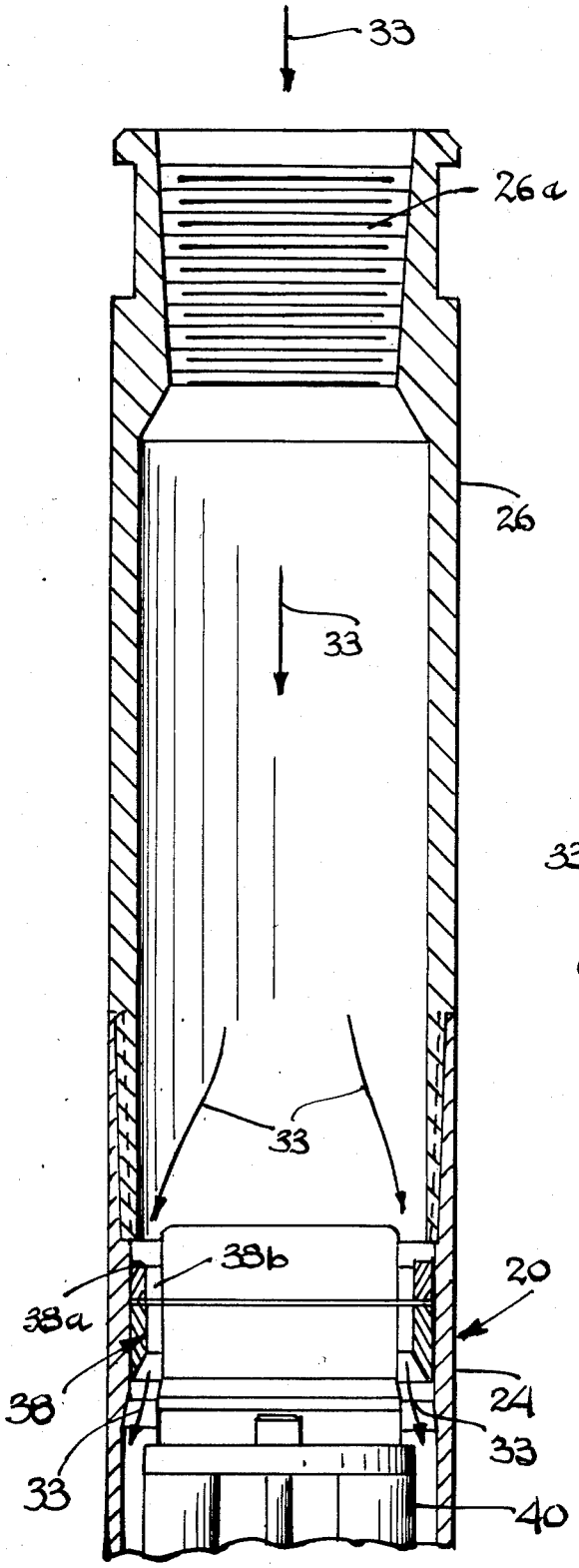
FIGS. 2A and 2B are elevational views illustrating the elastic type isolator and the oscillator unit of the first embodiment.
Figure 2B:
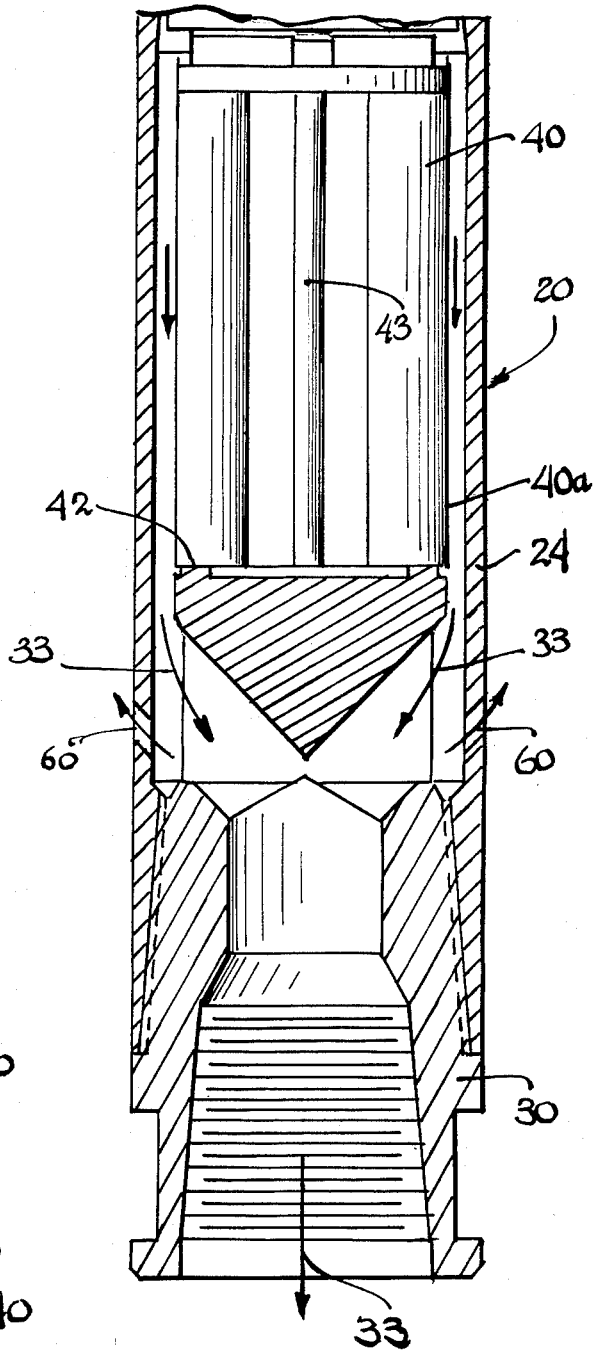
Figure 3:
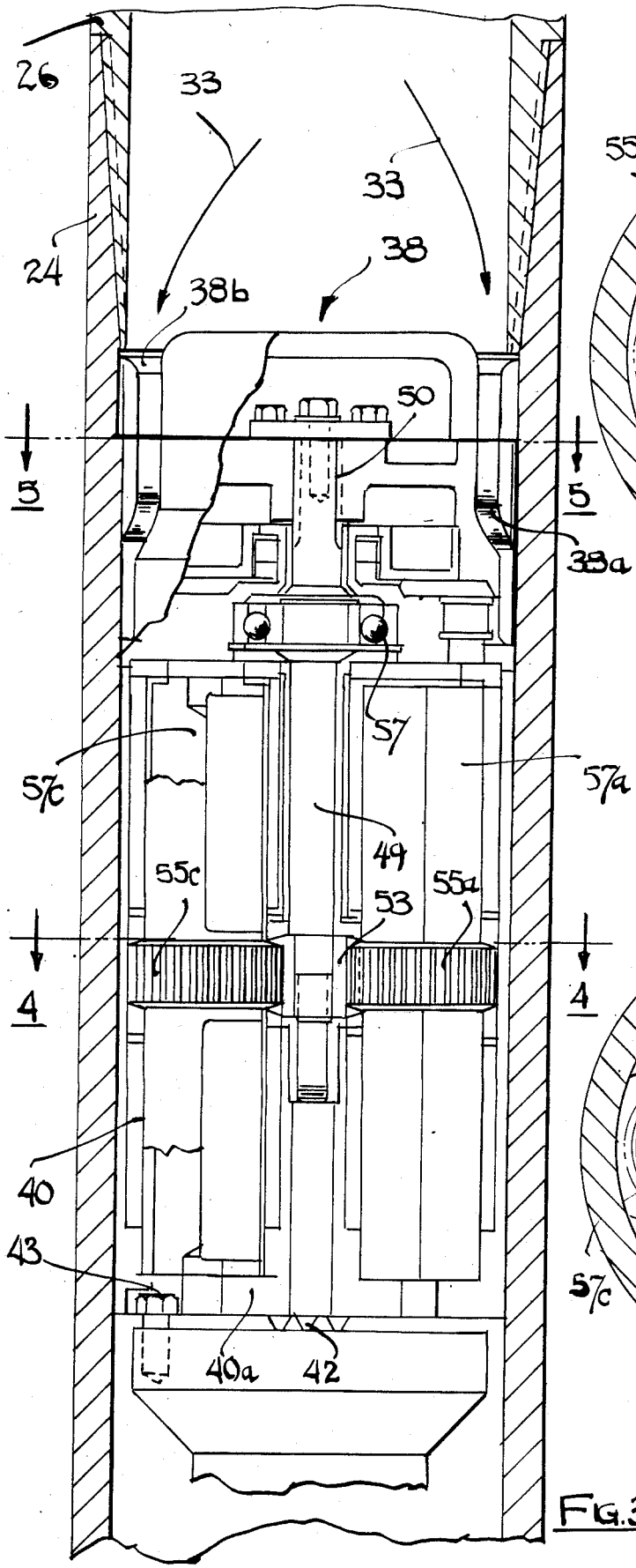
FIG. 3 is a cross sectional view showing the oscillator and turbine drive of the first embodiment.

Referring now to FIGS. 2A, 2B, 3, 4, 4A and 5 a first embodiment of the sonic drive unit of the invention is shown. The housing 24 of the sonic drive assembly 20 is coupled to the bottom end of spring pipe section 16 by means of coupling adapter unit 26 (See FIGS. 1A and 1B) which is threadably attached to the end of pipe 16 by means of threaded coupler 26A. The bottom end of coupler 26 is threadably attached to the top end of housing 24. The bottom end of housing 24 is threadably attached to coupler adapter 30 which adapter in turn is threadably attached to toothed grappler unit 18 as shown in FIG. 2B. Turbine assembly 38 is mounted within housing 24 and has a series of turbine blades 38A which are rotatably driven by the mud stream indicated by arrows 33, this mud stream being impelled from the surface and passing through nozzles 38B of the turbine to drive the blades thereof. The turbine blades are coupled to the rotors of orbiting mass oscillator 40 as to be explained in detail in connection with FIGS. 3, 4, 4A and 5. The housing 40A of the oscillator is clamped to coupling adapter 30 by means of a curvic coupling 42 and a series of bolts 43 as best can be seen in FIG. 3.

Referring now to FIGS. 3, 4, 4A and 5, the details of the first embodiment of the oscillator and its associated drive assembly are illustrated. Oscillator drive shaft 49 is supported for rotation on ball bearing assembly 57 and is rotatably driven by the turbine 38 which is coupled to the shaft through spline teeth 50. The turbine as already pointed out is rotatably driven by the mud stream indicated by arrows 33 which impinges on the turbine blades 38A. The rotatable drive of shaft 49 is coupled through sun gear 53 to the four planet drive gears 55A–55D for oscillator rotors 57A–57D respectively, each of the drive gears being integral with its associated rotor. The mud flow from the turbine is directed within casing 24 and past the oscillator housing and on down to the lower part of casing 24 where the mud flow is brought back to a central axial flow in coupling adapter 30 as shown in FIG. 2B. This flow then continues down through the tool joint and out into the stuck section of piping to aid the loosening thereof. On the other hand if it is not desired to continue the flow down inside of the string below this point outlet ports 60 may be provided as shown in FIG. 2B.

Figure 4:
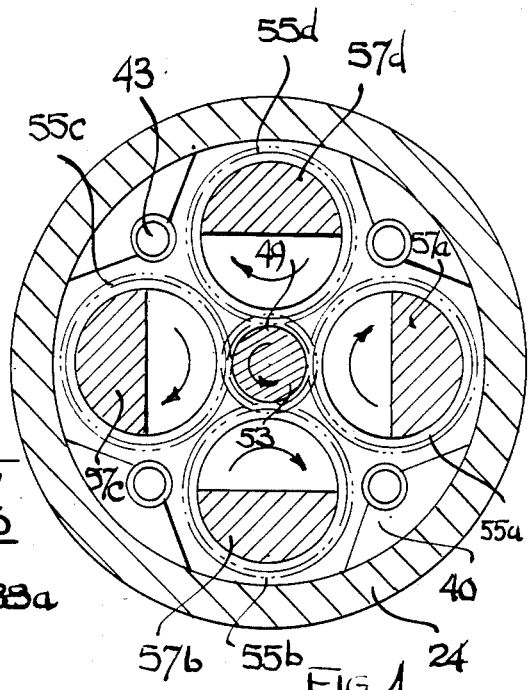
FIG. 4 is a cross sectional view taken along a plane indicated by 4—4 in FIG. 3.
Figure 4A:
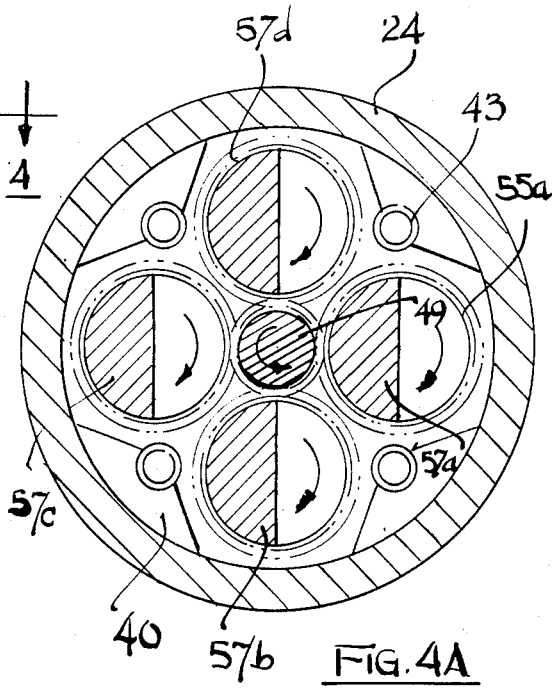
FIG. 4A is a cross sectional view similar to that of FIG. 4 which shows the oscillator rotors phased in a different manner from that shown in FIG. 4.
Figure 5:
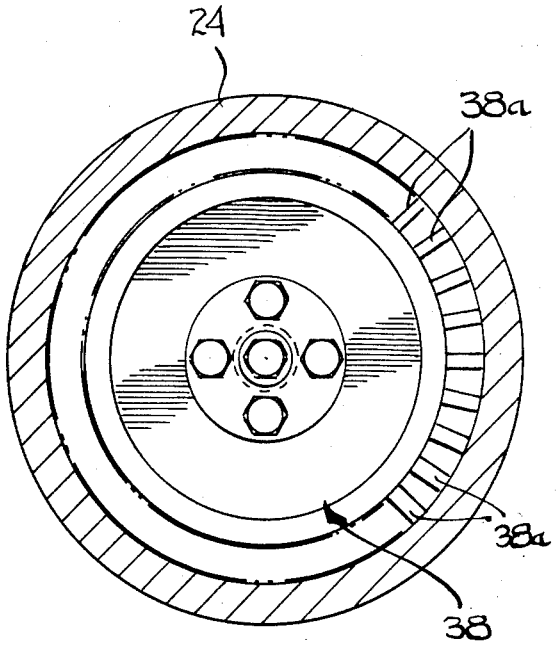
FIG. 5 is a cross sectional view taken along the plane indicated by 5—5 in FIG. 3.

On assembly, the geared rotors 57A–57D may be phased as shown in FIG. 4 to provide torsional cyclic output from the oscillator housing or on the other hand a quadrature vibration can be obtained by phasing the rotors as shown in FIG. 4A. It is also possible to phase the gears so that the phasing is intermediate between that shown in FIGS. 4 and 4A to provide an output that is a mixture of torsional and quadrature vibration. In this manner, various types of vibrational energy can be generated to optimize the freeing of the stuck section of pipe.

Figure 6:
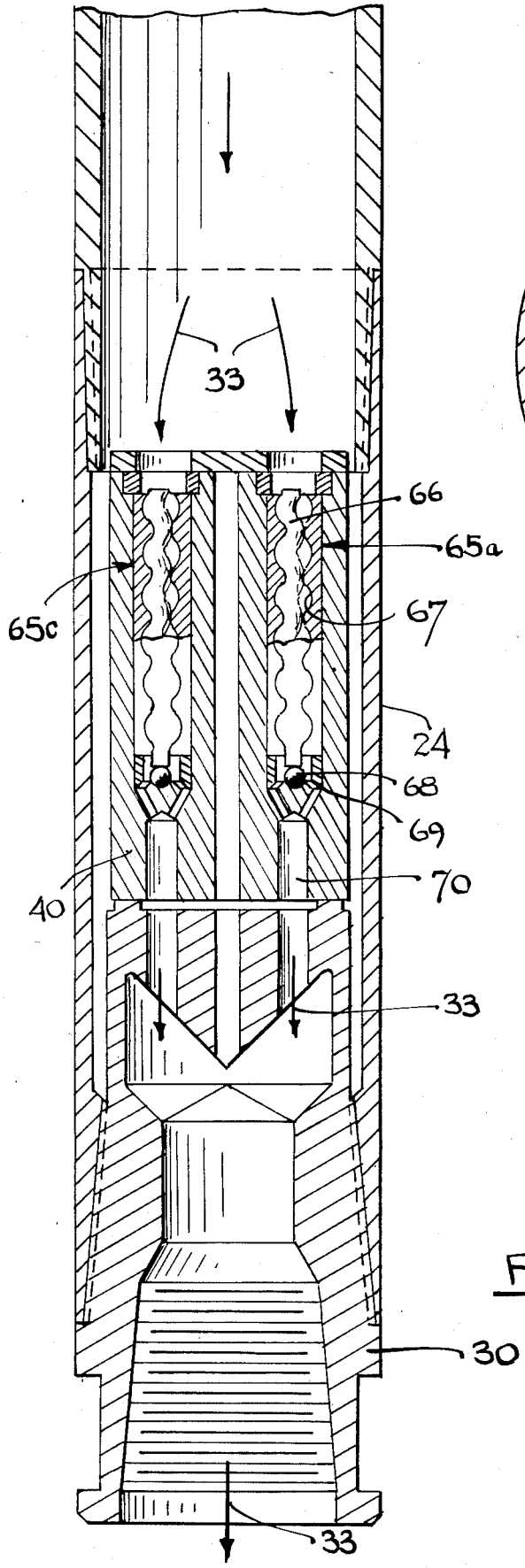
FIG. 6 is an elevational view in cross section illustrating a second embodiment of the oscillator which may be employed in the system of the invention.

Referring now to FIG. 6 a second embodiment of a power drive and oscillator unit which may be employed in the system of the invention is illustrated. As for the previous embodiment, this embodiment employs four oscillator rotary units which can automatically phase themselves to provide torsional or quadrature vibration. The oscillator units, however, rather than having conventional rotors are "moyno" type oscillator units. These oscillator units are directly driven by the mud stream 33 and do not require the turbine drive of the previous embodiment. Thus, a much simpler and more economical configuration is provided in this embodiment which is well adapted to rugged down hole conditions. In this embodiment the oscillator rotors cannot be phased in advance and are free to assume a phase relationship to provide torsional quadrature or other lateral modes of vibration as the load and operating conditions such as resonance mode freedom may dictate. There are four oscillator units as in the first embodiment (Only 65A and 65C are shown in the FIG.), each employing a single pitch screw shaped rotor 66 which may roll around the inner surface of a smooth cylinder or a mating screw shape multiple pitch stator 67, this orbital rolling of the rotor in all cases being the source of the desired lateral orbiting vibratory force vector. A thrust bearing for the bottom of the rotors 66 is provided by balls 68 which are supported and constrained laterally for rolling and for picking up radial loads within holders 69. The rotors 66 are rotatably driven by means of the mud stream indicated by arrows 33, the mud stream being exited through channels 70. The rotors 66 may also be straight cylindrical rollers that are mud driven in rolling fashion within the cylindrical stators 67.

In operation, the liquid flow indicated by arrows 33 drives the rotors 66 in parallel to provide rotary lateral oscillatory energy at the desired resonant frequency (this being largely determined by the resonance response of the stuck drill pipe remnant 19). The mode of vibration automatically adapts to the load such that as the subsection of stuck pipe starts to loosen or the point of sticking starts to move, a different more suitable mode of vibration may be automatically assumed.

While the invention has been described and illustrated in detail, it is to be clearly understood that this is intended by way of illustration and example only and is not to be taken by way of limitation, the spirit and scope of the invention being limited only by the terms of the following claims:

I claim:

1. A method for freeing a section of drill pipe stuck in a well bore a substantial distance from the surface, said stuck section of pipe being connected to a drill string running to the surface, comprising the steps of, determining the location of the stuck section of pipe, disengaging the drill string running to the surface from the stuck section of pipe at a predetermined distance above the point where the pipe is stuck, withdrawing the disengaged drill string from the bore hole, connecting an orbiting mass oscillator unit and drive means for such unit to the bottom end of the drill string withdrawn from the bore hole and to be reinstalled therein, connecting a grappling device for engaging the stuck section of drill pipe to the bottom of the oscillator unit, lowering the drill string to be reinstalled along with the oscillator and grappling device into the well bore to effect the engagement of the grappling device with the stuck section of drill pipe, running a pressurized stream of liquid through the drill string to cause the drive means to rotatably drive the oscillator so as to generate lateral vibrational energy at a predetermined frequency, said energy being coupled to the stuck section of drill pipe to implement the freeing thereof, the frequency of said energy being such as to effect resonant standing wave vibration of the stuck section of pipe at a low order harmonic.

2. The method of claim 1 and additionally including the step of interposing vibrational isolator means between the disengaged drill string section and the oscillator to minimize the transfer of vibrational energy from the oscillator to said last mentioned drill string section.

3. The method of claim 2 wherein said vibrational isolator means comprises a pipe section forming a resonant vibration system at the frequency of the vibrational output of the oscillator, a standing wave pattern being established in said pipe section so as to present a low impedance to the sonic energy at the end thereof coupled to the oscillator and a high impedance at the end thereof coupled to the disengaged drill string section running to the surface.

4. The method of claim 3 wherein said pipe section forms a resonant vibration system comprising an elastic spring pipe and heavy collar member, said elastic spring pipe being coupled at one end thereof to one end of said heavy collar member, the other end of said elastic spring pipe being coupled to the oscillator, the other end of the heavy collar member being coupled to the disengaged drill string section.

* * * * *